US006855211B2

(12) United States Patent
Chen et al.

(10) Patent No.: US 6,855,211 B2
(45) Date of Patent: Feb. 15, 2005

(54) RAPIDLY EVAPORATING CLEANING COMPOSITIONS

(75) Inventors: Hang-Chang Bobby Chen, Getzville, NY (US); Edward A. Rowe, Grand Island, NY (US)

(73) Assignee: Emerald Agrochemicals Company AVV, Londrina (BR)

( * ) Notice: Subject to any disclaimer, the term of this patent is extended or adjusted under 35 U.S.C. 154(b) by 552 days.

(21) Appl. No.: 10/073,321

(22) Filed: Feb. 13, 2002

(65) Prior Publication Data

US 2002/0129840 A1 Sep. 19, 2002

Related U.S. Application Data

(62) Division of application No. 08/644,144, filed on May 10, 1996, now abandoned.

(51) Int. Cl.[7] ..... B08B 3/00

(52) U.S. Cl. ..... 134/36; 134/38; 134/40; 252/364; 510/175; 510/176; 510/177; 510/200; 510/276; 510/285; 510/365; 510/371; 510/407; 510/408; 510/409; 510/410; 510/411; 510/412

(58) Field of Search ..... 134/36, 38, 40; 252/364; 510/175, 176, 177, 200, 276, 285, 365, 371, 407, 408, 409, 410, 411, 412

(56) References Cited

U.S. PATENT DOCUMENTS

| | | | | | |
|---|---|---|---|---|---|
| 3,546,304 | A | | 12/1970 | Patron | |
| 4,232,072 | A | | 11/1980 | Pardee | |
| 4,274,829 | A | | 6/1981 | Zurbucher | |
| 4,578,209 | A | | 3/1986 | Hisamoto et al. | |
| 5,242,502 | A | * | 9/1993 | Rowe | 134/10 |
| 5,244,507 | A | | 9/1993 | Rowe | |
| 5,744,437 | A | * | 4/1998 | Rowe et al. | 134/38 |
| 5,756,002 | A | * | 5/1998 | Chen et al. | 252/364 |
| 5,851,435 | A | * | 12/1998 | Chen et al. | 252/364 |
| 6,020,299 | A | * | 2/2000 | Chen et al. | 134/40 |

FOREIGN PATENT DOCUMENTS

| | | |
|---|---|---|
| WO | WO 94 28196 A1 | 12/1994 |

* cited by examiner

*Primary Examiner*—Randy Gulakowski
(74) *Attorney, Agent, or Firm*—Browdy and Neimark, P.L.L.C.

(57) ABSTRACT

Disclosed is a composition of about 20 to about 80 wt % benzotrifluoride and about 20 to about 80 wt % trichloroethylene. Up to about 1 wt % of a stabilizer for the trichloroethylene can be included in the composition.

14 Claims, No Drawings

RAPIDLY EVAPORATING CLEANING COMPOSITIONS

The present application is a division of parent application Ser. No. 08/644,144, filed May 10, 1996 now abandoned.

BACKGROUND OF THE INVENTION

This invention relates to a cleaning composition that has an unusually fast evaporation rate. In particular, it relates to a composition of benzotrifluoride and 1,1,2-trichloroethylene.

In manufacturing electronics, textiles, and apparel, it is necessary to remove grease, oil, and other soils left by machinery. A solvent that was widely used in industry for cleaning is 1,1,1-trichloroethane because it is non-flammable, has a low odor, readily dissolves greases and oils, and has a rapid evaporation rate, which is important for high speed processing. However, 1,1,1-trichloroethane has now been banned because it has found to be an ozone depletor. As a result, there is a great need in the industry for a substitute solvent that has some or all of the desirable properties of 1,1,1-trichloroethane, but which is not an ozone depletor.

SUMMARY OF THE INVENTION

We have discovered that a blend of benzotrifluoride (BTF) and 1,1,2-trichioroethylene (TCE) is an excellent substitute solvent for 1,1,1-trichloroethane. This blend is economical, readily dissolves oils and greases, is non-flammable, and has only a slight ethereal odor, which is not regarded as objectionable.

Its most important and unusual property, however, is its high evaporation rate. Not only does this blend dry almost as rapidly as 1,1,1-trichloroethane, but, very unexpectedly, it dries faster than either of its components! That is, the evaporation rate of the blend is higher than the evaporation rate of either benzotrifluoride or 1,1,2-trichloroethylene. As of now we have no explanation for this unusual phenomenon.

DESCRIPTION OF THE PREFERRED EMBODIMENTS

The composition of this invention is a blend of about 20 to about 80 wt % benzotrifluoride and about 20 to about 80 wt % TCE. Preferably, the blend is about 60 to 80 wt % benzotrifluoride and about 20 to about 40 wt % TCE because TCE is the more regulated component.

The blend can also include various optional ingredients such as up to about 1 wt % of a stabilizer for the TCE. A stabilizer is preferably present at a concentration of about 0.01 to about 1 wt %. Examples of suitable stabilizers include butylene oxide, ethyl acetate, diisopropyl amine, and epichlorohydrin. The preferred stabilizer is butylene oxide because it stays with the solvent during distillation.

The composition of this invention is a single phase composition and remains a liquid from about −25° C. to about 86° C. It can be used to clean electronics, textiles, and for contact cleaning and general cleaning. In addition, it can also be used as a solvent carrier for powdered metals, as an ink carrier, or in gravure printing. It can be used as a liquid wash or as an aerosol. Other uses will no doubt be apparent to those skilled in the art.

The following examples further illustrate this invention.

EXAMPLE 1

Evaporation Rate

Benzotrifluoride (BTF) was mixed with TCE at various concentrations. The mixtures were tested for relative evaporation time using ASTM test D 1901-85. All tests were run in triplicates in a draft-free area. The following table summarizes the average evaporation rate with reference to butyl acetate (BuAc):

| Concentration of TCE in BTF (wt %) | Relative Evaporation Rate* (BuAc = 1) |
|---|---|
| 0 | 2.74 |
| 25 | 3.88 |
| 50 | 5.08 |
| 75 | 5.48 |
| 100 | 3.84 |

*"Dry Time" of BuAc divided by "Dry Time" of TCE in BTF

The above table shows that TCE concentrations of 25 to 75 wt % in BTF evaporate faster than either 100 wt % TCE or 100 wt % BTF.

EXAMPLE 2

Cleaning

The ability of various solvents to clean mineral oil was determined by weight difference. Approximately the same amounts, 30 mg, of mineral oil were brushed onto 7.6 by 1.3 cm (3 by ½) steel coupons. The coated coupons were weighed and placed into 20 ml of a test solvent for 30 seconds, 2 minutes, and 4 minutes. No agitation was provided. The coupons were removed from the solvents, allowed to air dry for at least 30 minutes, and weighed again. The difference in weight measured the extent of cleaning. This test was repeated three times for each solvent and cleaning time combination. The traditional cleaning solvent, 1,1,1-trichloroethane (TCA), was also included for the comparison.

| | Weight % of Mineral Oil Left On Coupon | | |
|---|---|---|---|
| | TCA | BTF | 50/50 (By wt.) BTF/TCE |
| 30-second cleaning | 3.6 | 1.9 | 1.1 |
| 2-minute cleaning | 1.1 | 0.3 | 0.3 |
| 4-minute cleaning | 0.5 | 0.4 | 0.1 |

The above table shows that the 50/50 mixture of BTF/TCE was the superior cleaning solvent.

EXAMPLE 3

Ink Dissolving Rate

Pantone Reflex Blue ink paste was added at 2-gram increments to 20 grams of various solvents in a glass vial. After each addition, the mixtures were stirred, visually examined for miscibility, and the dissolving rates were recorded. The additions were continued until no more ink paste was soluble or until a total of 20 to 22 grams of the ink paste had been added to the solvent. The following table gives the solvents tested and the results.

| Solvent | Amount of Ink Added (grams) | Ink Dissolving Rate |
|---|---|---|
| 50/50 (by wt.) BTF/TCE | 22.5 | Extremely Fast |
| Monochlorotoluene (MCT)[1] | 20.7 | Extremely Fast |
| Parachlorobenzotrifluoride (PCBTF)[2] | 20.5 | Very Fast |
| BTF | 20.3 | Very Fast |
| Aromatic hydrocarbon having a flashpoint of 38° C. (100° F.)[3] | 20.4 | Very Fast |
| 50/50 (by wt.) PCBTF/MCT | 20.1 | Fast |
| Toluene | 20.3 | Fast |
| Aromatic hydrocarbon having a flashpoint of 66° C. (150° F.)[4] | 4.6 | Rather Slow |
| 30/70 (by wt.) MCT/ aliphatic hydrocarbon having a flashpoint of 110° C.[5] | 10.4 | Rather Slow |
| Aliphatic hydrocarbon having a flashpoint of 110° C.[5] | 22.5 | Very Slow |

[1]Sold by Occidental Chemical Corporation as "OXSOL ®10"
[2]Sold by Occidental Chemical Corporation as "OXS0L ®100"
[3]Sold by Exxon as "Aromatic 100"
[4]Sold by Exxon as "Aromatic 150"
[5]Sold by Exxon as "Exxsol D 110"

The above table shows that BTF/TCE had the best ink dissolving rate of the solvents tested.

What is claimed is:

1. A method of cleaning an article comprising contacting and thereby at least partly cleaning said article with a composition comprising:

(1) about 20 weight % to about 80 weight % benzotrifluoride, (2) about 20 weight % to about 80 weight % 1,1,2-trichloroethylene, and (3) a stabilizer for said 1,1,2-trichloroethylene, said stabilizer being present in amount no greater than about 1 weight %.

2. The method of claim 1, wherein said stabilizer is present in said composition in an amount of at least 0.01 weight %.

3. The method of claim 2, wherein said stabilizer is butylene oxide.

4. The method of claim 1, wherein said composition consists essentially of said benzotrifluoride in an amount of about 60 weight % to about 80 weight %, said 1,1,2-trichloroethylene in amount of about 20 weight % to about 40 weight %, and said stabilizer.

5. The method of claim 4, wherein said stabilizer is present in said composition in an amount of at least 0.01 weight %.

6. The method of claim 5, wherein said stabilizer is butylene oxide.

7. The method of claim 1, wherein said composition consists of said benzotrifluoride in an amount of about 60 weight % to about 80 weight %, said 1,1,2-trichloroethylene in an amount of about 20 weight % to about 40 weight %, and said stabilizer.

8. The method of claim 7, wherein said stabilizer is present in said composition in an amount of at least 0.01 weight %.

9. The method of claim 7, wherein said stabilizer is butylene oxide.

10. The method of claim 2, wherein said stabilizer is selected from the group consisting of butylene oxide, ethyl acetate, diisopropyl amine and epichlorohydrin.

11. The method of claim 1, wherein said composition consists essentially of said stabilizer in an amount no greater than 1 wt %, said benzotrifluoride in an amount of about 25 weight % to about 75 weight %, and said 1,1,2-trichloroethylene in an amount of about 25 weight % to about 75 weight %.

12. The method of claim 1 wherein said composition is a single-phase composition and remains a liquid from about −25° C. to about 86° C.

13. The method of claim 1 wherein said composition is a composition which dries faster than either benzotrifluoride or 1,1,2-trichloroethylene.

14. The method of claim 1 wherein said composition is substantially free of any other component.

* * * * *